US006280913B1

(12) United States Patent
Irving et al.

(10) Patent No.: US 6,280,913 B1
(45) Date of Patent: Aug. 28, 2001

(54) PHOTOGRAPHIC ELEMENT COMPRISING AN ION EXCHANGED PHOTOGRAPHICALLY USEFUL COMPOUND

(75) Inventors: Mark E. Irving; Lyn M. Irving; John M. Noonan, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/593,049

(22) Filed: Jun. 13, 2000

(51) Int. Cl.[7] ..... G03C 1/72
(52) U.S. Cl. ..... 430/496; 430/403; 430/404
(58) Field of Search ..... 430/496

(56) References Cited

U.S. PATENT DOCUMENTS

| | | | |
|---|---|---|---|
| 2,732,299 | 1/1956 | Morrison | 430/151 |
| 3,157,503 | 11/1964 | Kosar | 430/151 |
| 3,179,517 | 4/1965 | Tregillus et al. | 430/206 |
| 3,180,731 | 4/1965 | Roman et al. | 430/203 |
| 3,220,846 | 11/1965 | Tinker et al. | 430/179 |
| 3,271,155 | 9/1966 | Aebi | 430/159 |
| 3,420,665 | 1/1969 | Bialczak | 430/179 |
| 3,457,075 | 7/1969 | Morgan et al. | 430/350 |
| 3,493,374 | 2/1970 | Wilhelmus et al. | 430/159 |
| 3,531,286 | 9/1970 | Renfrew | 430/351 |
| 3,615,617 | 10/1971 | Cologne et al. | 430/614 |
| 3,674,478 | 7/1972 | Grasshoff et al. | 430/219 |
| 3,698,898 | 10/1972 | Grasshoff et al. | 430/219 |
| 3,700,457 | 10/1972 | Youngquist | 430/352 |
| 3,761,270 | 9/1973 | De Mauriac et al. | 430/351 |
| 3,791,830 | 2/1974 | Abele | 430/611 |
| 3,839,049 | 10/1974 | Simons | 430/619 |
| 3,844,797 | 10/1974 | Willems et al. | 430/495.1 |
| 3,846,136 | 11/1974 | Sullivan | 430/353 |
| 3,993,661 | 11/1976 | Grasshoff et al. | 548/251 |
| 3,994,732 | 11/1976 | Winslow | 430/619 |
| 4,009,029 | 2/1977 | Hammond et al. | 430/219 |
| 4,021,249 | 5/1977 | Bernett | 430/619 |
| 4,022,617 | 5/1977 | McGuckin | 430/203 |
| 4,060,420 | 11/1977 | Merkel et al. | 430/566 |
| 4,128,557 | 12/1978 | Knight et al. | 430/619 |
| 4,137,079 | 1/1979 | Houle | 430/336 |
| 4,138,265 | 2/1979 | Shiao | 430/505 |
| 4,144,072 | 3/1979 | Ikenoue | 430/353 |
| 4,245,033 | 1/1981 | Eida et al. | 430/353 |
| 4,260,677 | 4/1981 | Winslow et al. | 430/618 |
| 4,310,612 | 1/1982 | Mooberry et al. | 430/223 |
| 4,335,200 | 6/1982 | Ohashi et al. | 430/446 |
| 4,350,752 | 9/1982 | Reczek et al. | 430/219 |
| 4,351,896 | 9/1982 | Altland et al. | 430/354 |
| 4,378,424 | 3/1983 | Altland et al. | 430/352 |
| 4,404,390 | 9/1983 | Altland et al. | 548/109 |
| 4,416,977 | 11/1983 | Ohashi et al. | 430/446 |
| 4,420,554 | 12/1983 | Ohashi et al. | 430/446 |
| 4,438,195 | 3/1984 | Kunitz et al. | 430/566 |
| 4,451,561 | 5/1984 | Hirabayashi et al. | 430/619 |
| 4,460,681 | 7/1984 | Frenchik | 430/502 |
| 4,480,025 | 10/1984 | Chang et al. | 430/206 |
| 4,511,644 | 4/1985 | Okamura et al. | 430/219 |
| 4,570,236 | 2/1986 | Rebel et al. | 364/900 |
| 4,678,735 | 7/1987 | Kitaguchi et al. | 430/203 |
| 4,775,614 | 10/1988 | De Rycke | 430/340 |
| 4,837,141 | 6/1989 | Kohno et al. | 430/559 |
| 4,883,747 | 11/1989 | Grieve et al. | 430/542 |
| 4,888,268 | 12/1989 | Itoh et al. | 430/218 |
| 5,440,366 | 8/1995 | Reiss | 354/301 |
| 5,478,703 | 12/1995 | Simons | 430/383 |

FOREIGN PATENT DOCUMENTS

| | | |
|---|---|---|
| 59-168441 | 9/1984 | (JP) . |
| 59-180537 | 10/1984 | (JP) . |
| 61-51139 | 5/1994 | (JP) . |

OTHER PUBLICATIONS

Research Disclosure 15776, *Base Generating Aminimides for Photographic Materials*, May 1977, pp. 67–68.
Research Disclosure 29963, *Photothermographic Silver Halide Systems*, Mar. 1989, pp. 208–14.
Research Disclosure 17029, *Photothermographic Silver Halide Systems*, Jun. 1978, p. 9–15.
Research Disclosure 16977, *Antifoggants in Certain Photographic and Photothermographic Materials*, May 1978, p. 67–9.
Research Disclosure 16979, *Stabilizer Compound for Dye Enhanced Photothermographic Material*, May 1978, p. 66–6.
Japanese Patent Abstract JP 651699 A, Jan. 12, 1969.
Japanese Patent Abstract JP 50022625 A, Mar. 11, 1975.

*Primary Examiner*—Hoa Van Le
(74) *Attorney, Agent, or Firm*—Edith A. Rice

(57) ABSTRACT

A photographic element comprises at least one light-sensitive layer on a support wherein the photographic element also comprises at least one photographically useful compound, other than a reducing agent, ionically bound to an ion exchange matrix.

42 Claims, 2 Drawing Sheets

PHOTOGRAPHIC ELEMENT COMPRISING AN ION EXCHANGED PHOTOGRAPHICALLY USEFUL COMPOUND

FIELD OF THE INVENTION

This invention pertains to photographic elements, and in particular to photographic elements incorporating photographically useful compounds stabilized using ion exchange polymers, a method of activating the photographically useful compound, a method of processing said photographic element, a sheet which optionally contains a photographically useful compound stabilized using ion exchange polymers, and methods of processing a photographic element in the presence of said sheet.

BACKGROUND OF THE INVENTION

It is well known in the art that the introduction of photographically useful compounds, such as photographic couplers, development inhibitors, base, base precursors, fixing agents, i.e., ligand capable of binding silver, silver stabilizing agents and the like, into photographic elements can lead to premature reaction of the photographically useful compound with the other components of the photographic element.

One embodiment of this invention relates to photographic processing and, in particular to a method of fixing employing a fixer sheet that can be laminated to a photographic material to be processed. In conventional photographic processing it is usual to form an image by developing an imagewise exposed silver halide photographic material and then removing the unexposed (and undeveloped) silver halide with a fixer solution. The fixer solution contains a silver halide solvent, typically an alkali metal or ammonium thiosulphate, which forms soluble complexes with the silver halide which then pass into the solution thus leaving the photographic material substantially free of silver halide. The silver salt diffusion transfer process is also well known and provides a black-and-white image by placing an imagewise exposed silver halide material in face-to-face contact with a receiving layer in the presence of a silver halide solvent, a silver halide developing agent and silver precipitating nuclei. In the initial developing phase, a silver image is developed in the silver halide material while, in a second phase, undeveloped silver halide is transported as a soluble complex with the silver halide solvent to the receiving layer where metallic silver is deposited adjacent to the silver precipitating nuclei having been formed by reduction of the solubilised silver halide by developing agent.

In a variation of the above processes it is known to process photographic materials by placing them in face-to-face contact with a receiver sheet in the presence of a developing agent and a silver halide solvent. A recent example of such a process is described in U.S. Pat. No. 4,775,614 in which receiver sheets comprise a water-absorbing polymer layer, silver precipitating nuclei and a silver halide solvent. U.S. Pat. No. 3,179,517 describes a method of fixing black-and-white materials by lamination to a receptor element wherein, inter alia, zinc sulphide is used as a silver ion precipitating agent. The precipitation reaction in this case being a conversion reaction (metathesis). In this reaction the silver halide is converted to silver sulphide and the zinc sulphide to zinc halide.

U.S. Pat. No. 4,480,025 describes the bleaching and fixing of a developed color silver halide photographic material by using a bleach-fix sheet comprising a water-supplying layer, a bleaching agent, a silver halide solvent and a dye mordant. The particular use exemplified is to bleach and fix a color diffusion transfer material so that the retained image is usable. This system operates at an acid pH and contains an oxidizing agent to achieve the bleaching of silver.

Applying the concept of fixing by lamination to a camera speed film material, presents special problems. Due to the practice of using high silver halide levels coupled with partial development of the grains (a technique employed to achieve the best granularity) there are high levels of silver halide to remove. This leads to incomplete removal of silver halide when using previously suggested systems. U.S. Pat. No. 5,478,703 overcomes this deficiency by providing a method of fixing a developed photographic silver halide material comprising at least 2 silver halide layers sensitized to different regions of the spectrum, comprising placing the material in face-to-face contact with a fixer sheet in the presence of a processing solution and a silver halide solvent which forms a solubilised silver halide species from the undeveloped areas of the material, wherein the fixer sheet contains reducing means capable of forming metallic silver therein from the solubilised silver halide. The provision of a means of fixing a photographic film or other material which avoids the need for a separate fixing bath with its associated difficulties of silver recovery or disposal when exhausted is useful. The process can also operate with lower levels of silver halide solvent than conventional fixing baths, and can result in less escape of fixing agent into the environment. The fixer sheet can also conveniently be sent away for recovery and recycling of the silver. An important further advantage of the invention over conventional fixing baths is that it allows products of photographic color processing to be trapped in the receiver sheet and therefore not discharged into the environment. This is particularly valuable for smaller scale photofinishing operations where full-scale pollution control equipment to treat their effluent would be too costly and inconvenient. The silver halide solvent, such as sodium thiosulphate, which is necessary for the process, may be coated in whole or part in the fixing sheet.

Other variations of photographic processing using dry photographic processing elements have been described in the art. In one technique a single processing element is brought into contact with the photosensitive film to carry out photographic development. U.S. Pat. No. 5,440,366 to Reiss and Cocco teaches a photographic processing system and method wherein individual dry photographic processing elements are sequentially wrapped onto a single processing spool.

While there has been interest in carrying out photographic processing of exposed photosensitive film with dry processing elements, the systems and methods described in the prior art have not been entirely satisfactory insofar as providing the desired results. Accordingly, there is a continuing need for novel and improved systems and methods for forming images in exposed photosensitive films using dry photographic processing materials.

Silver halide photothermographic imaging materials, especially "dry silver" compositions, processed with heat and without liquid development have been known in the art for many years. Such materials are a mixture of light insensitive silver salt of an organic acid (e.g., silver behenate), a minor amount of catalytic light sensitive silver halide, and a reducing agent for the silver source. The light sensitive silver halide is in catalytic proximity to the light insensitive silver salt such that the latent image formed by the irradiation of the silver halide serves as a catalyst nucleus for the oxidation-reduction reaction of the organic silver salt with the reducing agent when heated above 80° C. Such media are described in U.S. Pat. Nos. 3,457,075; 3,839,049; and 4,260,677. Toning agents can be incorporated to improve the color of the silver image of photothermographic emulsions as described in U.S. Pat. Nos. 3,846,136; 3,994,732 and 4,021,249. Various methods to produce dye images and multicolor images with photographic color couplers and leuco dyes are well known in the art as represented by U.S. Pat. Nos. 4,022,617; 3,531,286; 3,180,731; 3,761,270; 4,460,681; 4,883,747 and Research Disclosure 29963.

A common problem that exists with these photothermographic systems is the instability of the image following processing. The photoactive silver halide still present in the developed image may continue to catalyze print-out of metallic silver even during room light handling. Thus, there exists a need for stabilization of the unreacted silver halide with the addition of separate post-processing image stabilizers or stabilizer precursors to provide the desired post-processing stability. Most often these are sulfur containing compounds such as mercaptans, thiones, thioethers as described in Research disclosure 17029. U.S. Pat. No. 4,245,033 describes sulfur compounds of the mercapto-type that are development restrainers of photothermographic systems as do U.S. Pat. Nos. 4,837,141 and 4,451,561. Mesoionic 1,2,4-triazolium-3-thiolates as fixing agents and silver halide stabilizers are described in U.S. Pat. No. 4,378,424. Substituted 5-mercapto-1,2,4-triazoles such as 3-amino-5-benzothio-1,2,4-triazole as post-processing stabilizers are described in U.S. Pat. Nos. 4,128,557; 4,137,079; 4,138,265, and Research Disclosures 16977 and 16979.

Some of the problems with these stabilizers include thermal fogging during processing or losses in photographic sensitivity, maximum density or, contrast at stabilizer concentrations in which stabilization of the post-processed image can occur. Stabilizer precursors have blocking or modifying groups that are usually cleaved during processing with heat and/or alkali. This provides the remaining moiety or primary active stabilizer to combine with the photoactive silver halide in the unexposed and undeveloped areas of the photographic material. For example, in the presence of a silver halide precursor in which the sulfur atom is blocked upon processing, the resulting silver mercaptide will be more stable than the silver halide to light, atmospheric and ambient conditions.

Various blocking techniques have been utilized in developing the stabilizer precursors. U.S. Pat. No. 3,615,617 describes acyl blocked photographically useful stabilizers. U.S. Pat. Nos. 3,674,478 and 3,993,661 describe hydroxyarylmethyl blocking groups. Benzylthio releasing groups are described in U.S. Pat. No. 3,698,898. Thiocarbonate blocking groups are described in U.S. Pat. No. 3,791,830, and thioether blocking groups in U.S. Pat. Nos. 4,335,200, 4,416,977, and 4,420,554. Photographically useful stabilizers which are blocked as urea or thiourea derivatives are described in U.S. Pat. No. 4,310,612. Blocked imidomethyl derivatives are described in U.S. Pat. No. 4,350,752, and imide or thioimide derivatives are described in U.S. Pat. No. 4,888,268. Removal of all of these aforementioned blocking groups from the photographically useful stabilizers is accomplished by an increase of pH during alkaline processing conditions of the exposed imaging material.

Other blocking groups which are thermally sensitive have also been utilized. These blocking groups are removed by heating the imaging material during processing. Photographically useful stabilizers blocked as thermally sensitive carbamate derivates are described in U.S. Pat. Nos. 3,844,797 and 4,144,072. These carbamate derivatives presumably regenerate the photographic stabilizer through loss of an isocyanate. Hydroxymethyl blocked photographic reagents which are unblocked through loss of formaldehyde during heating are described in U.S. Pat. No. 4,510,236. Development inhibitor releasing couplers releasing tetrazolylthio moieties are described in U.S. Pat. No. 3,700,457. Substituted benzylthio releasing groups are described in U.S. Pat. No. 4,678,735; and U.S. Pat. Nos. 4,351,896 and 4,404,390 utilize carboxybenzylthio blocking groups for mesoionic 1,2,4-triazolium-3-thiolates stabilizers. Photographic stabilizers which are blocked by a Michael-type addition to the carbon-carbon double bond of either acrylonitrile or alkyl acrylates are described in U.S. Pat. Nos. 4,009,029 and 4,511,644, respectively. Heating of these blocked derivatives causes unblocking by a retro-Michael reaction.

Thus, there has been a continued need for improved post-processing stabilizers that do not fog or desensitize the photographic materials, and stabilizing compounds that release the stabilizing moiety at the appropriate time and do not have any detrimental effects on the photosensitive material or user of said material.

Compounds from which bases are released by heating are referred to as "base precursors". The base precursors are employed in various systems designed so that the bases released by heating can function therein. Examples of such systems include heat-developable photographic materials, heat-sensitive recording materials, anion-polymerizable adhesives, film formation by coating, sealing materials, caulking materials, and the like.

One of the most favorable uses of the base precursors is for various types of image-forming materials for which heat is utilized (e.g., heat-developable photographic materials and heat-sensitive recording materials, etc.). In these materials the over all performance largely depends on the base precursor, because the formation of images takes place by reactions of other chemical species included therein which are activated by the base released by heating. The base precursor must rapidly release the base at a heating temperature as low as possible and be stable to storage conditions at the same time.

Examples of typical base precursors include salts of carboxylic acids and organic bases as described in U.S. Pat. No. 3,493,374 (triazine compounds and carboxylic acids), British Patent 998,949 (trichloroacetic acid salts), U.S. Pat. No. 4,060,420 (sulfonylacetic acid salts), JP-A-59-168441 (The term "JP-A" as used herein means an "unexamined published Japanese patent application") (sulfonylacetic acid salts), JP-A-59-180537 (propiolic acid salts), JP-A-60-237443 (phenylsulfonylacetic acid salts substituted by a sulfonyl group), and JP-A-61-51139 (sulfonylacetic acid salts). Other base precursors which have heretofore been known include ureas as described in U.S. Pat. No. 2,732,299 and Belgian Pat. No. 625,554, ammonium salts of urea or urea and weak acids as described in Japanese Patent Publication No. 1699/65, hexamethylenetetramine and semicarbazide as described in U.S. Pat. No. 3,157,503, dicyandiamide derivatives as described in U.S. Pat. No. 3,271,155, N-sulfonylureas as described in U.S. Pat. No. 3,420,665, and amineimides as described in Research Disclosure, RD No. 15776 (1977). The use of these salts as the base precursors stems from the fact that decarboxylation of the carboxylic acids by heating results in the release of the organic bases. However, these precursors have been insufficient in compatibility of rapidity of the release of the bases on heat treatment (activity) with stability on storage (storability).

The most useful base precursors are salts of a carboxylic acid and an organic base. Examples of useful carboxylic acid are trichloroacetic acid and trifluoroacetic acid, and examples of useful base are guanidine, piperidine, morpholine, p-toluidine, and 2-picoline. Particularly useful base precursor is guanidine trichloroacetate as described in U.S. Pat. No. 3,220,846. Further, aldoneamides described in Japanese Patent Application (OPI) No. 22625/75 (the term "OPI" as used herein means a "published unexamined Japanese patent application") decompose at high temperatures to release a base, and are preferably used.

Of the base precursors described above, water-soluble base precursors, however, have a disadvantage such that they are easily changeable on reacting with other components contained in coating materials. Furthermore, since those water-soluble base precursors are added in the form of an aqueous solution, those are uniformly present in the coating and are readily affected by air or moisture. Hence, the water-soluble base precursors are decomposed under the action of air or moisture to change photographic characteristics of the light-sensitive material, thereby deteriorating the storage stability of the light-sensitive material.

Water-insoluble base precursors have heretofore been used in the manner such that these are first dissolved in an organic solvent which is compatible with water, such as methanol, ethanol, acetone, or dimethylformamide, and then the resulting solution is added to an emulsion layer and/or its adjacent layer of the light-sensitive material. This is an industrially convenient method to introduce a water-insoluble additive into the light-sensitive material. In the method, however, the amount of the solvent which can be introduced into the light-sensitive material is limited. No serious problem arises when the amount of the additive added is small but in the case of the base precursor which must be added in a large amount, the amount of organic solvent which is required to dissolve therein the base precursor often exceeds the upper limit. Furthermore, many base precursors are sparingly soluble in such organic solvent which is compatible with water and those are difficult to add to the light-sensitive material.

There therefore exists the need for base precursors that have high mobility in photographic coatings, yet will remain immobile during raw stock keeping and not interact with other components or air. The base precursors of the present invention, ionically bound to an ion exchange matrix, are immobile. The compounds are tightly bound to the resin and do not wander through a coating. This includes not only compounds that have limited aqueous solubility, but also compounds that are highly water soluble.

PROBLEM TO BE SOLVED BY THE INVENTION

There has been a need for a photographic element incorporating a photographically useful compound which is stable until it is needed. The photographically useful compounds must be stable in the element during incubation, but not so stable as to be inactive during processing. There has also been a need for a process for developing an image in a photographic element which utilizes less wet chemistry and employs processing solutions having simplified compositions.

SUMMARY OF THE INVENTION

These and other needs have been satisfied by providing photographic elements comprising polymers with ion exchangeable groups (ionomers, polyesterionomers, and ion-containing latices) which limit diffusion of photographically useful compounds under coating conditions. The immobilization of photographically useful compound prevents interaction with the silver halide emulsion under film storage conditions. The active compound can be released from the ion exchange polymer by contacting the film with a high ionic strength solution and/or a solution of appropriate pH to release the active compound from the ion exchange polymer, and/or raising the temperature to release the active compound. In the case of cation release, for example, the high pH environment initiates cation release by deprotonating the active compound molecule. This breaks the ionic interaction between the previously protonated compound and the ion exchange polymer, allowing the compound molecules to diffuse away from the ion exchange polymer. A second driving force for compound diffusion can be provided by immersion in a high ionic strength solution. In this case, the high concentration of ions in the activating solution compete with the compound for the exchange sites of the ion exchange polymer, which tends to displace the compound from the exchange sites.

One aspect of the invention comprises a photographic element comprising a supportbearing a layer comprising at least one photographically useful compound, other than a reducing agent ionically bound to an ion exchange matrix.

The ionic exchanged photographically useful compounds are preferentially coated in a light-sensitive silver halide emulsion containing layer, in a layer adjacent to or otherwise in reactive association with an emulsion containing layer, in an overcoat, in an undercoat, on the opposite side of the support from an emulsion pack, or in a layer or combination of layers contained on a separate laminate sheet that at some point in a process is brought into reactive association with a photographic emulsion layer. Some examples for locating the photographically useful compound are given below.

1a. ion exchanged photographically useful compound incorporated within a light sensitive image element and placed in a light sensitive layer.

1b. ion exchanged photographically useful compound incorporated within a light sensitive image element and placed in reactive association in an adjacent non light sensitive layer.

1c. ion exchanged photographically useful compound incorporated within a light sensitive image element and placed on the other side of the support from the light sensitive layers.

2. ion exchanged photographically useful compound incorporated within a separate coated element which is brought into reactive association with a light sensitive image element for the purpose of accomplishing one or more steps of photographic chemical processing.

Another aspect of this invention comprises a method of activating a photographically useful compound incorporated in a photographic element which comprises at least one light-sensitive layer on a support, wherein the photographic element also comprises at least one photographically useful compound having a group ionically bound to an ion exchange matrix, said method comprising contacting the element with a solution or solution contained within a coated binder having an ionic strength of greater than 0.001 M.

Another aspect of this invention comprises a method of activating a photographically useful compound incorporated in a photographic element which comprises at least one light sensitive layer on a support, wherein the photographic element also comprises at least one photographically useful compound ionically bound to an ion exchange matrix said method comprising heating the element to a temperature above about 50° C.

Yet another aspect of this invention comprises a method of processing the photographic element with at least one light-sensitive layer on a support wherein the photographic element also comprises at least one photographically useful compound ionically bound to an ion exchange matrix, said method comprising contacting the element with a processing solution or a solution contained within a coated binder having a pH greater than 8.

Still another aspect of this invention comprises a sheet comprising a binder and at least one photographically useful group ionically bound to an ion exchange resin.

A further aspect of this invention comprises a method of processing a photographic element comprising at least one silver halide light-sensitive emulsion layer which comprises contacting the element with (a) a processing solution and (b) a sheet comprising a binder, and a photographically useful compound ionically bound to ion exchange resin.

Yet another aspect of this invention is a method of processing a photographic element comprising at least one silver halide light-sensitive emulsion layer which comprises contacting the element with (a) a processing solution having a pH of about 8–13 and (b) a sheet comprising a photographically useful compound, other than a reducing agent, ionically bound to an ionic exchange matrix.

Another aspect of this invention comprises a method of processing a photographic element comprising at least one silver halide light-sensitive emulsion layer which comprises contacting the element with (a) a processing solution having an ionic strength of greater than 0.001 M and (b) a sheet comprising a binder, and at least one photographically useful compound ionically bound to an ion exchange resin.

Another aspect of this invention comprises a method of processing a photographic element comprising at least one silver halide light-sensitive layer which comprises contacting the element with (a) a sheet comprising a binder, at least one photographically useful compound ionically bound to an ion exchange resin and (b) with thermal energy to elevate the temperature above 50° C.

Yet another aspect of this invention is a method of imaging comprising the steps of forming an image in an imagewise exposed light sensitive silver alide element comprising a photographically useful compound ionically bound to an ion exchange resin; scanning said formed image to form a first electronic image representation from said formed image, digitizing said first electronic image to obtain a digital image, modifying said digital image to form a second electronic image representation, and storing, transmitting, printing or displaying said second electronic image representation.

DETAILED DESCRIPTION OF THE INVENTION

Figure 1:
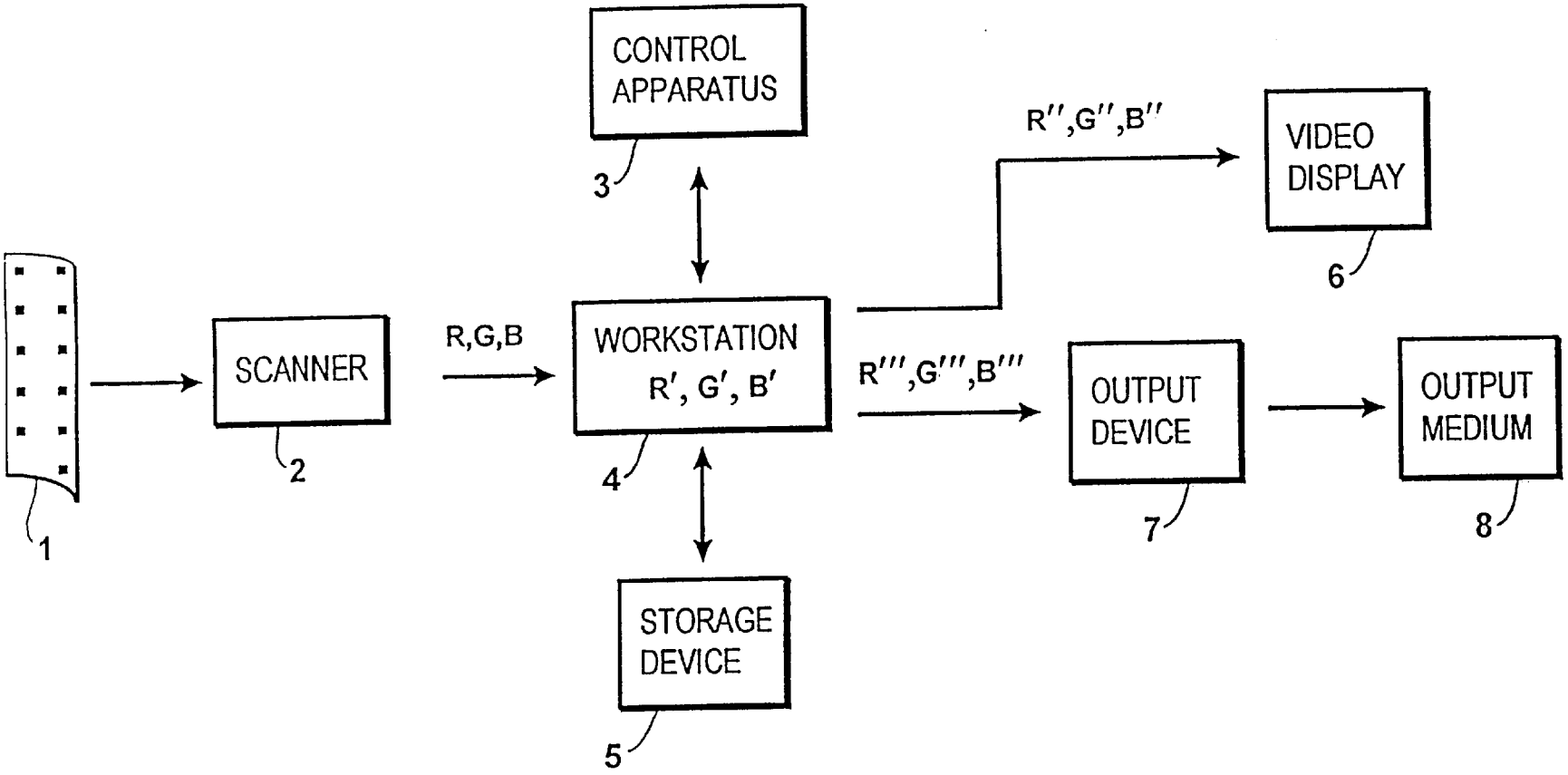
FIG. 1 shows in block diagram form an apparatus for processing and viewing image formation obtained by scanning a photographic element of this invention.

The principles of ion exchange are well known and are described, for example, in *Chemical Engineer's Handbook,* Fifth Edition, Section 16. Ion exchange materials generally consist of a solid phase containing bound groups that carry an ionic charge, either positive or negative, in conjunction with free ions of opposite charge that can be displaced. Ion exchange materials have the characteristic of selectively taking up and storing one or more ionized solute species from a fluid phase. The concentration of bound ionic groups in the ion exchange material is called the stoichiometric capacity. The maximum uptake of a specific solute by the ion exchange resin is related to the stoichiometric capacity of the resin and to the adsorption strength of the solute to those bound groups. Ionic exchange resins useful in this invention include, for example, organic synthetic resins, inorganic resins and the like.

Cation-exchange resins generally contain bound sulfonic acid groups (for example, $SO_3^-$). These resins are typically commercially available in either the acidic form or the sodium form. Additionally, cation-exchange resins contain other bound acid groups such as carboxylic, phosphonic, phosphinic, (for example, $COO^-$, $PO_3^{2-}$, $HPO_2^-$, $AsO_2^-$, $SeO_3^-$, etc). Preferred cationic ion exchange resins are sulfonated copolymers derived from styrene and divinylbenzene with a sulfonation level of about 3 to about 5 meq/g. Anionic-exchange resins involve quaternary ammonium groups (strongly basic) or other amino groups (weakly basic). Such resins preferably contain one or more of the following ionic groups:

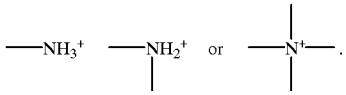

Preferred anionic ion exchange resins are derived from copolymers of styrene and divinylbenzene contain at least one of the above ionic groups. A preferred anionic ion exchange resin comprises a copolymer derived from styrene and divinylbenzene containing trimethylbenzylammonium chloride groups.

Ion exchange reactions are reversible and involve chemically equivalent quantities. It is possible to recover the solute and to purify and reuse the ion exchange resin. In this case, conditions for regeneration must also exist. This can be accomplished with a solution containing the ion initially present in the solid. An ever-present excess of this ion during the regeneration step will cause the reaction equilibrium to reverse itself, restoring the resin to its initial condition.

For use in this invention, the ion exchange preferably comprises particles of about 0.01 to about 10 micrometers ($\mu$m), more preferably about 0.05 to about 8 $\mu$m and most preferably about 0.1 to about 5 $\mu$m. Particles of the desired size can be prepared by standard techniques, such as milling, by preparing the particles by a limited coalescence procedure, or other procedures known in the art.

As discussed more fully below, in preferred embodiments of this invention the ion exchange resin is used in a photographic element. In those embodiments the ion exchange matrix preferably has a refractive index between 1.4 and 1.7. This provides acceptable optical clarity in the processed photographic element.

The photographic element of this invention comprises at least one photographically useful compound ionically bound to an ion exchange matrix. The photographic useful compound is present in an amount of about 5 to about 100, preferably about 10 to about 90 and most preferably about 15 to about 90 mol percent of the ion exchange stoichiometric capacity of the ion exchange resin. The terms "acid" and "acidic", "base" and "basic" are used herein to refer to compounds known as Lewis acids and Lewis bases. Acids are molecules or ions capable of coordinating with unshared electron pairs and bases are molecules or ions which have such unshared electron pairs available for coordination. Lewis acids will coordinate with the anionic exchangers, and Lewis bases with the cation exchangers.

The photographically useful compound can be, for example, a coupler, a development inhibitor, a base, a base precursor, an acid, an acid precursor, a ligand capable of binding silver, a fixing agent, a bleaching agent, a silver stabilizing agent, a toning agent, an antifoggant, and the like.

In a preferred embodiment of the invention the photographically useful compound is a fixing agent (i.e., a ligand that is capable of binding silver. A discussion of fixing agents can be found in *Research Disclosure* I Section XX, subsections B (1) to (4) and Section C.

Fixing agents are water-soluble solvents for silver halide such as a thiosulfate (e.g., sodium thiosulfate, ammonium thiosulfate, and potassium thiosulfate), a thiocyanate (e.g., sodium thiocyanate, potassium thiocyanate and ammonium thiocyanate), a thioether compound (e.g., ethylenebisthioglycolic acid and 3,6-dithia-1,8-octanediol), a thioglycolic acid or a thiourea, an organic thiol, an organic phosphine, a high concentration of halide, such as bromide or iodide, a mesoionic thiolate compound, and sulfite. These fixing agents can be used singly or in combination. Some fixing agents and their use in solid and liquid formulations are described in Mader U.S. Pat. No. 2,748,000, Bard U.S. Pat. No. 3,615,507, Nittel et al U.S. Pat. No. 3,712,818, Smith U.S. Pat. No. 3,722,020, Ling U.S. Pat. No. 3,959, 362, Greenwald U.S. Pat. Nos. 4,126,459, 4,211,562, and 4,211,559, Atland et al U.S. Pat. No. 4,378,424, Fyson U.S. Pat. Nos. 5,171,658, 5,244,778 and 5,275,923, Rogers et al U.S. Pat. No. 5,389,501, Kojima et al EPO 0 458 277, EPO 0 431 568, and EPO 0 500 045, Hayashi EPO 0 557 851, Buttner et al EPO 0 610 763, and Kojima et al EPO 0 611 990. Some low ammonia fixing solutions are described in Schmittou et al U.S. Pat. No. 5,183,727, Yoshimoto et al EPO 0 466 510, Fyson EPO 0 550 933 and Szajewski et al EPO 0 605 036, EPO 0 605 038 and EPO 0 605 039.

A fixing preparation or a bleach-fixing preparation may also contain preservatives such as sulfites (e.g., sodium sulfite, potassium sulfite, and ammonium sulfite), bisulfites (e.g., ammonium bisulfite, sodium bisulfite, and potassium bisulfite), metabisulfites (e.g., potassium metabisulfite, sodium metabisulfite, and ammonium metabisulfite), hydroxylamines, hydrazines, bisulfite adducts of carbonyl and aldehyde compounds (e.g., acetaldehyde sodium bisulfite), ascorbic acid, mercapto-substituted N-oxide compounds, and sulfinic acid compounds, e.g. as described in Watanabe et al U.S. Pat. No. 5,288,595. Compounds which may be added to accelerate fixing include polyoxyethylene compounds, amidine salts or amidine thiosulfates, ammonium or amine salts and organic amines, ammonium thiocyanate (ammonium rhodanate), thiourea and thioethers (for example, 3,6-dithia-1,8-octanediol) in combination with thiosul-fates. Some fixing accelerators and their use are described in U.K. Patent 1,306,315, Barnes U.S. Pat. No. 2,174,494, *Photographische Industrie,* 40, 249 (1942), Schmittou et al U.S. Pat. No. 5,424,176 and EPO 0 569 008, and Rogers et al EPO 0 578 309. Sulfite fix accelerators are described in Fyson EPO 0 411 760.

In order to adjust the pH of the fixing preparation an acid or a base may be added, such as hydrochloric acid, sulfuric acid, nitric acid, acetic acid, bicarbonate, ammonia, potassium hydroxide, sodium hydroxide, sodium carbonate or potassium carbonate. The fixing preparation may contain sequestering agents such as aminopolycarboxylic and phosphonic acids. Some sequesterants and their use are described in Fujita et al U.S. Pat. No. 4,963,474, Craver et al U.S. Pat. No. 5,343,035 and U.S. Pat. No. 5,508,150, and Tappe et al EPO 0 486 909. Fixing solutions may also contain polymers as described in Fushiki et al U.S. Pat. No. 4,138,257 and Kojima et al U.S. Pat. No. 4,948,711, solubilizing agents as described in Ikegawa et al U.S. Pat. No. 5,097,042, stain reducing agents as described in Sasaki et al U.S. Pat. No. 5,120,635, and surfactants as described in Ueda et al EPO 0 441 309.

Some variations on the fixing preparations already described include the fixing cover sheet of Simons WO 93/12462, the processes of Ueda et al U.S. Pat. No. 5,194, 368 and Nagashima et al U.S. Pat. No. 5,066,569, and the solid formulations of Kim et al U.S. Pat. No. 5,270,154.

Other compounds similar to those above have frequently been preferred more for their silver stabilization activity rather than silver ion solubility. In general, these are termed silver stabilizers. Most often these are sulfur-containing compounds such as mercaptans, thiones, and thioethers as described in Research Disclosure, June 1978, item 17029. U.S. Pat. Nos. 4,245,033; 4,837,141 and 4,451,561 describe sulfur compounds that are development restrainers for photothermographic systems. Mesoionic 1,2,4-triazolium-3-thiolates as fixing agents and silver halide stabilizers are described in U.S. Pat. No. 4,378,424. Substituted 5-mercapto-1,2,4-triazoles such as 3-amino-5-benzothio-1, 2,4-triazole as post-processing stabilizers are described in U.S. Pat. Nos. 4,128,557; 4,137,079; 4,138,265, and Research Disclosure, May 1978, items 16977 and 16979. U.S. Pat. Nos. 5,158,866 and 5,194,623 describe the use of omega-substituted 2-propionamidoacetyl or 3-propionamidopropionyl stabilizer precursors as post-processing stabilizers in photothermographic emulsions. U.S. Pat. No. 5,175,081 describes the use of certain azlactones as stabilizers, and isothiourea compounds described in U.S. Pat. Nos. 3,220,839 and 3,189,453 are also useful in this regard. name types or compounds—same as in the conventional system and/or others designed for laminate or PTG in particular?]. Many of these compounds have the ability to form a reactively stable and light-insensitive compound with silver ion. With stabilization, the silver is not necessarily removed from the film, although the fixing agent and stabilization agents could very well be a single chemical. The physical state of the stabilized silver is no longer in large (>50 nm) particles as it was for the silver halide and (optionally) silver donor, so the stabilized state is also advantaged in that light scatter and overall density is lower, rendering the image more suitable for scanning. The removal of the metallic silver is more difficult than removal of the silver halide and silver donor. In general, two reaction steps are involved. The first step is to bleach the metallic silver to silver ion. The second step may be identical to the removal/stabilization step(s) described for silver halide and silver donor above. Metallic silver is a stable state that does not compromise the archival stability of a film. Therefore, if stabilization of the film is favored over removal of silver, the bleach step can be skipped and the metallic silver left in the film. In cases where the metallic silver is removed, the bleach and fix preparations can be assembled together (sometimes called a blix) or sequentially (bleach+fix).

Bleaching and fixing preparations of this invention can be combined into a single bleach-fix preparation that can be used alone or in combination with separate bleaching and the fixing preparations. A combined bleach-fix is often used with a color paper process, such as the RA-4 Process described in the *British Journal of Photography Annual,* 1988, pp. 198–199. Examples of bleach-fixing preparations or dry formulations, and their use are further described in Hall et al U.S. Pat. No. 4,717,649, Ueda et al U.S. Pat. No. 4,818,673, Abe et al U.S Pat. No. 4,857,441, Haseler et al U.S. Pat. No. 4,933,264, Ishikawa et al U.S. Pat. No.

4,966,834, Spriewald et al U.S. Pat. No. 4,987,058, Long et al U.S. Pat. No. 5,055,382, Abe et al U.S. Pat. No. 5,104,775, Goto et al U.S. Pat. No. 5,147,765, Tappe et al U.S. Pat. No. 5,149,618, Ishikawa U.S. Pat. No. 5,169,743, Kobayashi et al U.S. Pat. No. 5,180,656, Yoshida et al U.S. Pat. No. 5,310,633, Fyson U.S. Pat. No. 5,354,647, Ishikawa et al EPO 0 434 097, Goto et al EPO 0 479 262, Nakamura et al EPO 0 565 023, Yoshida et al EPO 0 569 852, Gordon et al EPO 0 590 583 (bleach-fix replenisher) and EPO 0 645 674, Kamada et al EPO 0 686 875, and Wernicke et al German OLS 4,000,482.

In other embodiments of the invention the photographically useful compound is an image dye forming coupler, a base precursor, an antifoggant, a development inhibitor or any other photographically useful compound.

Image Dye-Forming Couplers are compounds which react with oxidized developer to release a dye. Illustrative couplers include cyan, magenta and yellow image dye-forming couplers that are known in the photographic art. Illustrative couplers which form cyan dyes upon reaction with oxidized color developing agents are phenols and naphthols. Representative couplers are described in the following patents and publications: U.S. Pat. Nos. 2,367,531; 2,423,730; 2,474,293; 2,772,162; 2,801,171; 2,895,826; 3, 002,836; 3,034,892; 3,041,236; 3,419,390; 3,476,563; 3,772,002; 3,779,763; 3,996,253; 4,124,396; 4,254,212; 4, 296,200; 4,333,999; 4,443,536; 4,457,559; 4,500,635; 4,526,864; 4,690,889; 4,775,616; and in "Farbkuppler ein Literaturuibersicht," published in Agfa Mitteilungen, Band III, pp. 156–175 (1961). Illustrative magenta dye-forming couplers are pyrazolones, pyrazolotriazoles, pyrazolobenzimidazoles and indazolones. Typical couplers arc described in U.S. Pat. Nos. 1,269,479; 2,311,082; 2,343,703; 2,369,489; 2,600,788; 2,673,801; 2,908,573; 3,061,432; 3,062,653; 3,152,896; 3,519,429; 3, 725,067; 3,935,015; 4,120,723; 4,443,536; 4,500,630; 4,540,654; 4,581,326; 4,774,172; European Patent Applications 170,164; 177,765; 284,239; 284,240; and in "Farbkuppler ein Literaturubersicht," published in Agfa Mitteilungen, Band III, pp. 126–156 (1961). Couplers which form yellow dyes upon reaction with oxidized color developing agents are typically acylacetanilides such as benzoylacetanilides and pivalylacetanilides. Representative couplers are described in U.S. Pat. Nos. 2,298,443; 2, 407,210; 2,875,057; 3,048,194; 3,265,506; 3,384,657; 3,415,652; 3,447,928; 3,542,840; 10 3,894,875; 3,933,501; 4, 022,620; 4,046,575; 4,095,983; 4,182,630; 4,203,768; 4,221,860; 4,326,024; 4,401,752; 4,443,536; 4,529,691; 4, 587,205; 4,587,207; 4,617,256; European Patent Application 296,793; and in "Farbkuppler ein Literaturubersicht," published in Agfa Mitteilungen, Band III, pp. 112126 (1961).

A base precursor is a substance which releases a basic component by heating thereby to activate light-sensitive material. Examples of typical base precursors are described in British Patent 998,949. A preferred base precursor is a salt of a carboxylic acid and an organic base. Examples of preferred carboxylic acids include trichloroacetic acid and trifluoroacetic acid. In the configuration for the current invention, the base moiety is the ionic functional group contained in the ion exchange matrix. Examples of preferred bases include guanidine, piperidine, morpholine, p-toluidine and 2-picoline, etc. Trichloroacetate as described in U.S. Pat. No. 3,220,846 is particularly preferred. Ammonium phthalamates such as 2-butyl-ammonium-N-(2 -butyl) phthalamate, can also be used. Such compounds are described in U.S. Pat. No. 4,088,496. Other useful bases are described in U.S. Pat. Nos. 5,064,742; 4, 656,124; 4,455,363; and 3,761,270.

The composition of the current invention may optionally contain an electron transfer agent. The term "electron transfer agent" or ETA is employed in its art recognized sense of denoting a silver halide developing agent that donates an electron (becomes oxidized) in reducing $Ag^+$ in silver halide to silver $Ag^0$ and is then regenerated to its original non-oxidized state by entering into a redox reaction with primary amine color developing agent. In the redox reaction the color developing agent is oxidized and hence activated for coupling.

Preferred electron transfer agents 1-aryl-3-pyrazolidinone derivatives, a hydroquinone or derivative thereof, a catechol or derivative thereof, or an acylhydrazine or derivative thereof. The electron transfer agent pyrazolidinone moieties which have been found to be useful in providing development acceleration function are derived from compounds generally of the type described in U.S. Pat. Nos. 4, 209,580; 4,463,081; 4,471,045; and 4,481,287 and in published Japanese patent application No. 62-123,172. Such compounds comprise a 3-pyrazolidinone structure having an unsubstituted or substituted aryl group in the 1-position. Preferably these compounds have one or more alkyl groups in the 4 or 5-positions of the pyrazolidinone ring. Particularly useful electron transfer agents are described in Platt et al U.S. Pat. No. 4,912,025, and Michno et al U.S. Pat. No. 4,859,578.

The photographically useful of the current invention can, for example, also include antifoggants ionically bound to an ion exchange matrix. Typical antifoggants are discussed in Section VI of Research Disclosure September 1996, Number 389, Item 38957, for example tetraazaindenes, mercaptotetrazoles, polyhydroxybenzenes, hydroxyaminobenzenes, combinations of a thiosulfonate and a sulfinate, azaindenes, triazoles, tetrazoles, imidazolium salts, polyhydroxy compounds and others. Antifoggants such as monohydric and polyhydric phenols of the type illustrated by Sheppard et al U.S. Pat. No. 2,165,421; nitrosubstituted compounds of the type disclosed by Rees et al U.K. Patent 1,269,268; poly(alkylene oxides) as illustrated by Valbusa U.K. Patent 1,151,914, and mucohalogenic acids in combination with urazoles as illustrated by Allen et al U.S. Pat. Nos. 3,232,761 and 3,232,764, or further in combination with maleic acid hydrazide as illustrated by Rees et al U.S. Pat. No. 3,295,980; and conventional antifoggants, such as those disclosed by Mifune et al U.S. Pat. Nos. 4,241,164, 4,311,781, 4,166,742, and 4,237,214, and Okutsu et al U.S. Pat. No. 4,221,857, can be employed.

Preferred antifoggants are benzotriazoles, such as benzotriazole (that is, the unsubstituted benzotriazole compound), halo-substituted benzotriazoles (e.g., 5-chlorobenzotriazole, 4-bromobenzotriazole, and 4-chlorobenzotriazole), and alkyl-substituted benzotriazoles wherein the alkyl moiety contains from about 1 to 12 carbon atoms (e. g., 5-methylbenzotriazole). Other known useful antifoggants include benzimidazoles, such as 5-nitrobenzimidazoles; benzothiazoles, such as 5-nitrobenzothiazole and 5-methylbenzothiazole; heterocyclic thiones, such as, 1methyl-2-tetrazoline-5-thione; triazines, such as 2,4-dimethylamino-6-chloro-5-triazine; benzoxazoles, such as ethylbenzoxazole; and pyrroles, such as 2,5-dimethylpyrrole, mercapto substituted heterocyclic compounds, such as 1-phenyl-5-mercaptotetrazole, 2-mercaptotetrazole, 2-mercaptobenzimidazole, and 2-mercaptobenzothiazole, and mercapto substituted aromatic compounds, such as thiosalicylic acid.

Other useful antifoggants include the following: oxazole, selenazole and thiazole antifoggants of the type disclosed by Brooker et al U.S. Pat. No. 2,131,038; imidazole antifoggants of the type disclosed by Weisseberger et al U.S. Pat. No. 2,324,123, Bean U.S. Pat. No. 2,384,593 and DeSelms U.S. Pat. No. 3,137,578; urazole antifoggants of the type disclosed by Carrol et al U.S. Pat. No. 2,708,162; tetraazaindene antifoggants of the type disclosed by Carroll et al U.S. Pat. No. 2,716,062, Piper U.S. Pat. No. 2, 886,437 and Heimbach U.S. Pat. No. 2,444,605; isothiouronium salt antifoggants of the type disclosed by Herz et al U.S. Pat. No. 3,220,839; cyclic hydrazide antifoggants of the type disclosed by Anderson et al U.S. Pat. No. 3,287,135 and Milton U.S. Pat. No. 3,295,981; pyrazolidone antifoggants of the type disclosed by Milton U.S. Pat. No. 3,420,670; aminomethylthiocarboxylic acid antifoggants of the type disclosed by Cossar et al U.S. Pat. No. 3,547,638; tetrazole antifoggants of the type disclosed by Tuite et al U.S. Pat. No. 3,576,638; thiazoline-2-thione antifoggants of the type disclosed by Herz U.S. Pat. No. 3,598,598; 4-Pyrimidinethione antifoggants of the type disclosed by Lamon U.S. Pat. No. 3,615,621; 4-Thiouracil antifoggants of the type disclosed by Lamon U.S. Pat. No. 3,622,340; Nitron; Nitroimidazole antifoggants, such as 6-nitroimidazole, 5-nitro-1H-imidazole; triazole antifoggants, such as benzotriazole, 5-methylbenzotriazole, 5,6-dichlorobenazotriazole, 4,5,6,7-tetrachloro-IH-benzotriazole; sulfocatechol antifoggants of the type disclosed by Kennard et al U.S. Pat. No. 3,236,652.

The photographically useful compound can be a development inhibitor (DIR). Any DIR which is known in the art, or mixtures of such DIR's, can be used. Such DIR's are described in, for example, U.S. Pat. Nos. 3,227,554; 3,384,657; 3,615,506; 3,617,291; 3,733,201; 4,248,962; 4,409,323; 4,546,073; 4,564,587; 4,618,571; 4,684,604; 4,698,297; 4,737,452; 4,782,012; 5,006,448; 5,021,555; 5,034,311; EP 255,085; EP 348,139; U.K. 1,450,479; and U.K. 2,099,167.

The ionically bound photographically useful compounds may be used in any form of photographic system. In a preferred embodiment of the invention the photographic element is a color negative film. Prints can be made from the film by conventional optical techniques or by scanning the film and printing using a laser, light emitting diode, cathode ray tube or the like.

A typical color negative film construction useful in the practice of the invention is illustrated by the following element, SCN–1:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly(ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV Supports of *Research Disclosure I,*

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU re formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than about 35 $\mu$m and preferably less than about 25 $\mu$m and most preferably less than about 20 $\mu$m.

Any convenient selection from among conventional radiation-sensitive silver halide emulsions can be incorporated within the layer units and used to provide the spectral absorptances of the invention. Most commonly high bromide or high chloride emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Further, the tabular grains can have either {111} or {100} major faces. Specifically preferred tabular grain emulsions are those having a tabular grain average aspect ratio of at least 5 and, optimally, greater than 8. Preferred mean tabular grain thicknesses are less than 0.3 μm (most preferably less than 0.2 μm). Ultrathin tabular grain emulsions, those with mean tabular grain thicknesses of less than 0.07 μm, are specifically contemplated. The grains preferably form surface latent images so that they produce negative images when processed in a surface developer in color negative film forms of the invention.

Illustrations of conventional radiation-sensitive silver halide emulsions are provided by *Research Disclosure,* Item 38957, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure,* Item 38957, cited above and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in Research Disclosure, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element.

Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure,* Item 38957. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light-sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per m$^2$ of support surface area in the element is preferred so as to realize an exposure latitude of at least 2.7 log E while maintaining an adequately low graininess position for pictures intended to be enlarged. For color display elements, substantially lower silver coating coverages are typically employed.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure,* Item 38957, cited above, X. Dye image formers and modifiers, B. Image-dye-forming couplers. The photographic elements may further contain other image-modifying compounds such as "Development Inhibitor-Releasing" compounds (DIR's). Useful additional DIR's for elements of the present invention, are known in the art and examples are described in U.S. Pat. No. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light-sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure,* Item 38957, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure,* Item 38957, VIII. Absorbing and scattering materials, B. Absorbing materials.

The antihalation layer unit AHU typically contains a processing solution removable or decolorizable light absorbing material, such as one or a combination of pigments and dyes. Suitable materials can be selected from among those disclosed in *Research Disclosure,* Item 38957, VIII. Absorbing materials. A common alternative location for AHU is between the support S and the recording layer unit coated nearest the support.

The surface overcoats SOC are hydrophilic colloid layers that arc provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure,* Item 38957, IX. Coating physical property modifying addenda. The SOC overlying the emulsion layers additionally preferably contains an ultraviolet absorber, such as illustrated by *Research Disclosure,* Item 38957, VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements useful in the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma as low as 1.0 or even 0.6 are contemplated and exposure latitudes of up to about 5.0 log E or higher are feasible. Gammas of about less than about 0.55 are preferred. Gammas of between about 0.4 and about 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure, Item* 38957, X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure, Vol.* 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research Disclosure, Vol.* 176, December 1978, Item 17643, XXIII. Image transfer systems.

A number of modifications of color negative elements have been suggested for accommodating scanning, as illustrated by *Research Disclosure* I, XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described by Arakawa et al U.S. Pat. No. 5,962,205, the disclosures of which are incorporated herein by reference. The imaging element may also comprise a pan-sensitized emulsion with accompanying color-separation exposure. In this embodiment, development of the photographic element of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering,* W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed.

The term "gamma ratio" when applied to a color recording layer unit refers to the ratio determined by dividing the color gamma of a cited layer unit after imagewise color separation exposure and process that enables development of primarily that layer unit by the color gamma of the same layer unit after imagewise white light exposure and process that enables development of all layer units. This term relates to the degree of color saturation available from that layer unit after conventional optical printing. Larger values of the gamma ratio indicate enhanced degrees of color saturation under optical printing conditions.

Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light-sensitive color forming units each exhibit gamma ratios of less than 1.15. In an even more preferred embodiment, the red and blue light-sensitive color forming units each exhibit gamma ratios of less than 1.10. In a most preferred embodiment, the red, green, and blue light-sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light-sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221. More generally, the size limited cameras most useful as one-time-use cameras will be generally rectangular in shape and can meet the requirements of easy handling and transportability in, for example, a pocket, when the camera as described herein has a limited volume. The camera should have a total volume of less than about 450 cubic centimeters (cc's), preferably less than 380 cc, more preferably less than 300 cc, and most preferably less than 220 cc. The depth-to-height-to-length proportions of such a camera will generally be in an about 1:2:4 ratio, with a range in each of about 25% so as to provide comfortable handling and pocketability. Generally the minimum usable depth is set by the focal length of the incorporated lens and by the dimensions of the incorporated film spools and cartridge. The camera will preferably have the majority of corners and edges finished with a radius-of-curvature of between about 0.2 and 3 centimeters. The use of thrust cartridges allows a particular advantage in this invention by providing easy scanner access to particular scenes photographed on a roll while protecting the film from dust, scratches, and abrasion, all of which tend to degrade the quality of an image.

While any known taking lens may be employed in the cameras of this invention, the taking lens mounted on the single-use cameras of the invention are preferably single aspherical plastic lenses. The lenses will have a focal length between about 10 and 100 mm, and a lens aperture between f/2 and f/32. The focal length is preferably between about 15 and 60 mm and most preferably between about 20 and 40 mm. For pictorial applications, a focal length matching to within 25% the diagonal of the rectangular film exposure area is preferred. Lens apertures of between f/2.8 and f/22 are contemplated with a lens aperture of about f/4 to f/16 being preferred. The lens MTF can be as low as 0.6 or less at a spatial frequency of 20 lines per millimeter (1 pm) at the film plane, although values as high as 0.7 or most preferably 0.8 or more are contemplated. Higher lens MTF values generally allow sharper pictures to be produced. Multiple lens arrangements comprising two, three, or more component lens elements consistent with the functions described above are specifically contemplated.

Cameras may contain a built-in processing capability, for example a heating element. Designs for such cameras including their use in an image capture and display system are disclosed in U.S. patent application Ser. No. 09/388,573, incorporated herein by reference Photographic elements of the present invention are preferably imagewise exposed using any of the known techniques, including those described in *Research Disclosure* I, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). Exposures are monochromatic, orthochromatic, or panchromatic depending upon the spectral sensitization of the photographic silver halide.

The elements as discussed above may serve as origination material for some or all of the following processes: image scanning to produce an electronic rendition of the capture image, and subsequent digital processing of that rendition to manipulate, store, transmit, output, or display electronically that image.

The ion exchanged photographically useful compounds of this invention may be used in photographic elements that contain any or all of the features discussed above, but are intended for different forms of processing. These types of systems will be described in detail below.

Type I: Thermal process systems (photothermographic), where processing is initiated solely by the application of heat to the imaging element.

Type II: Low volume systems, where film processing is initiated by contact to a processing solution, but where the processing solution volume is comparable to the total volume of the imaging layer to be processed. This type of system may include the addition of non solution processing aids, such as the application of heat or of a laminate layer that is applied at the time of processing.

Type III: Conventional photographic systems, where film elements are processed by contact with conventional photographic processing solutions, and the volume of such solutions is very large in comparison to the volume of the imaging layer.

Type I: Photothermographic Systems

In accordance with one aspect of this invention the ion exchanged photographically useful compound is incorporated in a photothermographic element. Photothermographic elements of the type described in Research Disclosure 17029 (Research Disclosure I) are included by reference. The photothermographic elements may be of type A or type B as disclosed in Research Disclosure I. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992.

The photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Prcferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 3-mercapto-4-phenyl-1,2,4 triazole, a silver salt of 2-mercaptobenzimidazole, a silver salt of 2-mercapto-5-aminothiadiazole, a silver salt of 2-(2-ethyl-glycolamido) benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123, 274, for example, a silver salt of 1,2,4-mercaptothiazole derivative such as a silver salt of 3-amino-5-benzylthio-1, 2,4-thiazole, a silver salt of a thione compound such as a silver salt of 3-(2-carboxyethyl)-4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl- 1,2,4-triazole, of 1H-tetrazole as described in U.S. Pat. No. 4,220,709, a silver salt of imidazole and an imidazole derivative, and the like.

It is also found convenient to use silver half soap, of which an equimolar blend of a silver behenate with behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used. A method for making silver soap dispersions is well known in the art and is disclosed in Research Disclosure October 1983 (23419) and U.S. Pat. No. 3,985,565.

Silver salts complexes may also be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by Research Disclosure, Item 17029, cited above, as well as U.S. Pat. No. 3,700,458 and published Japanese patent applications Nos. 32928/75, 13224/74, 17216/75 and 42729/76.

A reducing agent in addition to the ion exchanged photographically useful compound may be included. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer. Reducing agents ionically bound to ion exchange resins in co-filed U.S. Applications (docket 81196), (docket 81198), and (docket 79657) herein incorporated by reference are also contemplated.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenyl-hydroxamic acid, and β-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl cyano-2-methylphenylacetate, ethyl α-cyano-phenylacetate; bis-βnaphthols as illustrated by 2,2'-dihydroxyl-1-binaphthyl, 6,6'-dibromo-2,2'-dihydroxy- 1,1'-binaphthyl, and bis(2-hydroxy- 1-naphthyl) methane; a combination of bis-β-naphthol and a 1,3-dihydroxybenzene derivative, (e. g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1, 3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

The photographically useful group ionically bound to an ion exchange matrix of the current invention can comprise a toning agent, also known as an activator-toner or toner-accelerator. Combinations of toning agents are also useful in the photothermographic element. Examples of useful toning agents and toning agent combinations are described in, for example, *Research Disclosure,* June 1978, Item No. 17029 and U.S. Pat. No. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, salicylanilide, benzamide, and dimethylurea.

The photographically useful group ionically bound to an ion exchange matrix of the current invention may also comprise post-processing image stabilizers and latent image keeping stabilizers useful in a photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure,* December 1978, Item No. 17643 and *Research Disclosure,* June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photographically useful group of the current invention may also comprise a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis(tribromomethyl)-s-triazines, such as 6-methyl or 6-phenyl-2,4-bis(tribromomethyl)-s-triazine. Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent applications Ser. Nos. 09/206586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent applications Ser. Nos. 09/206,914 filed Dec. 7, 1998 and 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

Type II: Low Volume Processing:

In accordance with another aspect of this invention the ion exchanged photographically useful compound is incorporated in a photographic element intended for low volume processing. Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume processing system may contain any of the elements described above for Type I: Photothermographic systems. In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below.

The Type II photographic element may receive some or all of the following treatments:

(I) Application of a solution directly to the imaging element by any means, including spray, inkjet, coating, gravure process and the like.

(II) Soaking of the imaging element in a reservoir containing a processing solution. This process may also take the form of dipping or passing an element through a small cartridge.

(III) Lamination of an auxiliary processing element to the imaging element.The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element. It is specifically contemplated that the ion exchanged compounds of the current invention could be coated in either or both the imaging element and the laminate element, depending upon the function of the photographically useful compound.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may include processing temperatures ranging from room temperature to 100° C.

Type III: Conventional Systems:

In accordance with another aspect of this invention the ion exchanged photographically useful compound is incorporated in a conventional photographic element.

Conventional photographic elements in accordance with the invention can be processed in any of a number of well-known photographic processes utilizing any of a number of well-known conventional photographic processing solutions, described, for example, in *Research Disclosure* I, or in T. H. James, editor, *The Theory of the Photographic Process,* 4th Edition, Macmillan, New York, 1977. The development process may take place for any length of time and any process temperature that is suitable to render an acceptable image. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(2-(methanesulfonamido) ethylaniline sesquisulfate hydrate, 4-amino-3-methyl-N-ethyl-N-(2-hydroxyethyl)aniline sulfate, 4-amino-3-α-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, Research Disclosure, Vol.116, December, 1973, Item 11660, and Bissonette Research Disclosure, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development may be followed by bleach-fixing, to remove silver or silver halide, washing and drying.

Once yellow, magenta, and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available.

Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management,* Addison-Wesley, 1998.

FIG. 1 shows, in block diagram form, the manner in which the image information provided by the color negative elements of the invention is contemplated to be used. An image scanner 2 is used to scan by transmission an image-wise exposed and photographically processed color negative element 1. The scanning beam is most conveniently a beam of white light that is split after passage through the layer units and passed through filters to create separate image records—red recording layer unit image record (R), green recording layer unit image record (G), and blue recording layer unit image record (B). Instead of splitting the beam, blue, green, and red filters can be sequentially caused to intersect the beam at each pixel location. In still another scanning variation, separate blue, green, and red light beams, as produced by a collection of light emitting diodes, can be directed at each pixel location. As the element 1 is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to a workstation 4, and the information is transformed into an electronic form R', G', and B', which can be stored in any convenient storage device 5.

In motion imaging industries, a common approach is to transfer the color negative film information into a video signal using a telecine transfer device. Two types of telecine transfer devices are most common: (1) a flying spot scanner using photomultiplier tube detectors or (2) CCD's as sensors. These devices transform the scanning beam that has passed through the color negative film at each pixel location into a voltage. The signal processing then inverts the electrical signal in order to render a positive image. The signal is then amplified and modulated and fed into a cathode ray tube monitor to display the image or recorded onto magnetic tape for storage. Although both analog and digital image signal manipulations are contemplated, it is preferred to place the signal in a digital form for manipulation, since the overwhelming majority of computers are now digital and this facilitates use with common computer peripherals, such as magnetic tape, a magnetic disk, or an optical disk.

A video monitor 6, which receives the digital image information modified for its requirements, indicated by R", G", and B", allows viewing of the image information received by the workstation. Instead of relying on a cathode ray tube of a video monitor, a liquid crystal display panel or any other convenient electronic image viewing device can be substituted. The video monitor typically relies upon a picture control apparatus 3, which can include a keyboard and cursor, enabling the workstation operator to provide image manipulation commands for modifying the video image displayed and any image to be recreated from the digital image information.

Any modifications of the image can be viewed as they are being introduced on the video display 6 and stored in the storage device 5. The modified image information R'", G'", and B'" can be sent to an output device 7 to produce a recreated image for viewing. The output device can be any convenient element writer, such as a thermal dye transfer, ink-jet, electrostatic, electrophotographic, or other type of printer suitable for rendering a viewable image. The output device can be used to control the exposure of a silver halide color paper. The silver halide output medium and/or its method of processing may be conventional or modified according to the present invention. It is the image in the output medium that is ultimately viewed and judged by the end user for noise (granularity), sharpness, contrast, and color balance. The image on a video display may also ultimately be viewed and judged by the end user for noise, sharpness, tone scale, color balance, and color reproduction, as in the case of images transmitted between parties on the World Wide Web of the Internet computer network.

Using an arrangement of the type shown in FIG. 1, the images contained in color negative elements are converted to digital form, manipulated, and recreated in a viewable form following the procedure described in Giorgianni et al U.S. Pat. No. 5,267,030. Color negative recording materials can be used with any of the suitable methods described in U.S. Pat. No. 5,257,030. In one preferred embodiment, Giorgianni et al provides for a method and means to convert the R, G, and B image-bearing signals from a transmission scanner to an image manipulation and/or storage metric which corresponds to the trichromatic signals of a reference image-producing device such as a film or paper writer, thermal printer, video display, etc. The metric values correspond to those which would be required to appropriately reproduce the color image on that device. For example, if the reference image producing device was chosen to be a specific video display, and the intermediary image data metric was chosen to be the R', G', and B' intensity modulating signals (code values) for that reference video display, then for an input film, the R, G, and B image-bearing signals from a scanner would be transformed to the R', G', and B' code values corresponding to those which would be required to appropriately reproduce the input image on the reference video display. A data-set is generated from which the mathematical transformations to convert R, G, and B image-bearing signals to the aforementioned code values are derived. Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by transmission scanner which produces R, G, and B image-bearing signals corresponding each color patch. Signal-value patterns of code value pattern generator produces RGB intensity-modulating signals which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image-bearing signal values for the film's test colors to the R', G', and B' code values of the corresponding test colors.

The mathematical operations required to transform R, G, and B image-bearing signals to the intermediary data may consist of a sequence of matrix operations and look-up tables (LUT's).

Figure 2:
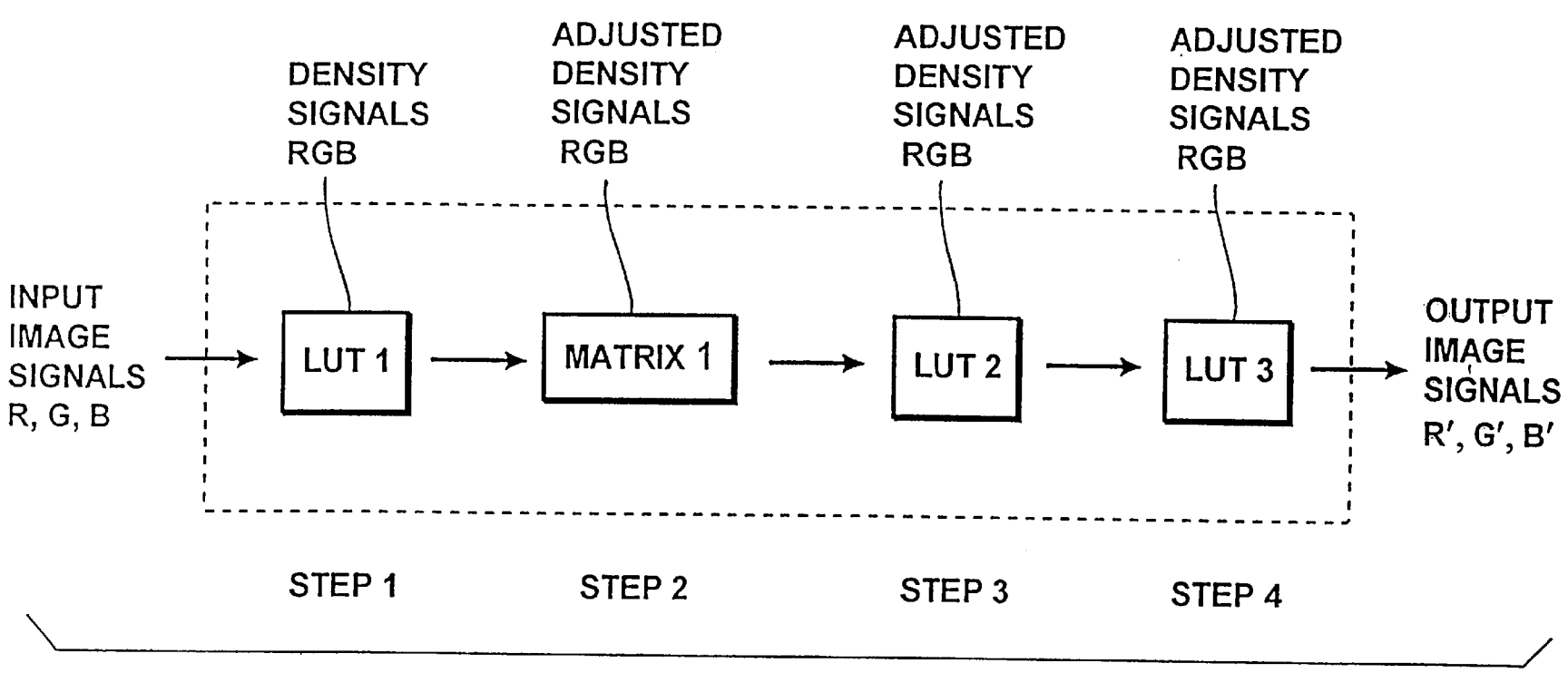
FIG. 2 is a block diagram showing electronic signal processing of image bearing signals derived from scanning a developed color element according to the invention.

Referring to FIG. 2, input image-bearing signals R, G, and B are transformed to intermediary data values corresponding to the R', G', and B' output image-bearing signals required to appropriately reproduce the color image on the reference output device as follows:

(1) The R, G, and B image-bearing signals, which correspond to the measured transmittances of the film, are converted to corresponding densities in the computer used to receive and store the signals from a film scanner by means of 1-dimensional look-up table LUT 1.

(2) The densities from step (1) are then transformed using matrix 1 derived from a transform apparatus to create intermediary image-bearing signals.

(3) The densities of step (2) are optionally modified with a 1-dimensional look-up table LUT 2 derived such that the neutral scale densities of the input film are transformed to the neutral scale densities of the reference.

(4) The densities of step (3) are transformed through a 1-dimensional look-up table LUT 3 to create corresponding R', G', and B' output image-bearing signals for the reference output device.

It will be understood that individual look-up tables are typically provided for each input color. In one embodiment, three 1-dimensional look-up tables can be employed, one for each of a red, green, and blue color record. In another embodiment, a multi-dimensional look-up table can be employed as described by D'Errico at U.S. Pat. No. 4,941,039. It will be appreciated that the output image-bearing signals for the reference output device of step 4 above may be in the form of device-dependent code values or the output image-bearing signals may require further adjustment to become device specific code values. Such adjustment may be accomplished by further matrix transformation or 1-dimensional look-up table transformation, or a combination of such transformations to properly prepare the output image-bearing signals for any of the steps of transmitting, storing, printing, or displaying them using the specified device.

The R, G, and B image-bearing signals from a transmission scanner are converted to an image manipulation and/or storage metric which corresponds to a measurement or description of a single reference image-recording device and/or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured RGB densities of that reference film, then for an input color negative film according to the invention, the R, G, and B image-bearing signals from a scanner would be transformed to the R', G', and B' density values corresponding to those of an image which would have been formed by the reference color negative film had it been exposed under the same conditions under which the color negative recording material was exposed.

Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by a transmission scanner which produces R, G, and B image-bearing signals corresponding each color patch and by a transmission densitometer which produces R', G', and B' density values corresponding to each patch. A transform apparatus creates a transform relating the R, G, and B image-bearing signal values for the film's test colors to the measured R', G', and B' densities of the corresponding test colors of the reference color negative film. In another preferred variation, if the reference image recording medium was chosen to be a specific color negative film, and the intermediary image data metric was chosen to be the predetermined R', G', and B' intermediary densities of step 2 of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the color negative recording material was exposed.

Thus each input film would yield, insofar as possible, identical intermediary data values corresponding to the R', G', and B' code values required to appropriately reproduce the color image which would have been formed by the reference color negative film on the reference output device. Uncalibrated films may also be used with transformations derived for similar types of films, and the results would be similar to those described.

The mathematical operations required to transform R, G, and B image-bearing signals to the intermediary data metric of this preferred embodiment may consist of a sequence of matrix operations and 1-dimensional LUTs. Three tables are typically provided for the three input colors. It is appreciated that such transformations can also be accomplished in other embodiments by employing a single mathematical operation or a combination of mathematical operations in the computational steps produced by the host computer including, but not limited to, matrix algebra, algebraic expressions dependent on one or more of the image-bearing signals, and n-dimensional LUTs. In one embodiment, matrix 1 of step 2 is a 3×3 matrix. In a more preferred embodiment, matrix 1 of step 2 is a 3×10 matrix. In a preferred embodiment, the 1-dimensional LUT 3 in step 4 transforms the intermediary image-bearing signals according to a color photographic paper characteristic curve, thereby reproducing normal color print image tone scale. In another preferred embodiment, LUT 3 of step 4 transforms the intermediary image-bearing signals according to a modified viewing tone scale that is more pleasing, such as possessing lower image contrast.

Due to the complexity of these transformations, it should be noted that the transformation from R, G, and B to R', G', and B' may often be better accomplished by a 3-dimensional LUT. Such 3-dimensional LUTs may be developed according to the teachings J. D'Errico in U.S. Pat. No. 4,941,039.

It is to be appreciated that while the images are in electronic form, the image processing is not limited to the specific manipulations described above. While the image is in this form, additional image manipulation may be used including, but not limited to, standard scene balance algorithms (to determine corrections for density and color balance based on the densities of one or more areas within the negative), tone scale manipulations to amplify film underexposure gamma, non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, inkjet printers, display monitors, CD disks, optical and magnetic electronic signal storage devices, and other types of storage and display devices as known in the art.

The following examples illustrate the invention and include use of both anionic- and cationic-exchange polymers to stabilize photographically useful compounds.

EXAMPLE 1

Demonstration of Silver Halide Fixing Agent Immobilization

The following ion exchanged fixing agent dispersion F1 was prepared.

F1

To 3 g of Amberjet™ 4400 OH strongly basic anion exchanger were added 29 g of a solution which contained 4.2 wt. % of sodium thiosulfate. The mixture was stirred for five minutes, and the resin particles were separated from the liquid phase. The resin particles were washed two times with 30 g of distilled, de-ionized water.

The resulting thiosulfate loaded resin particles were contacted with 15 cc of distilled water in which 1.2 mmol of silver bromoiodide tabular grains were suspended. After 30 minutes, the silver bromoiodide had not dissolved. This demonstrates that the thiosulfate was effectively immobilized on the ion-exchange resin particles. When 0.75 g of sodium chloride were added, the silver bromoiodide dissolved immediately. This demonstrates the ion-exchanged fixing agent is quickly released from the ion-exchange matrix with an activation step.

EXAMPLE 2

Demonstration of Ion Exchanged Fixing Agents in Coated Laminate Sheets

The following ion exchanged fixing agent dispersions F2 and F3 were prepared.

F2

To 10 g of Amberjet™ 4400 OH strongly basic anion exchanger were added 44 g of a solution which contained 10 wt. % of sodium thiocyanate. The mixture was stirred for five minutes, and the resin particles were separated from the liquid phase. The resin particles were washed with 50 g of distilled, de-ionized water three times. The resulting thiocyanate loaded resin particles were added to 90 g of distilled water. This slurry was sheared for 15 minutes with a rotor-stator mixer at ca. 15000 RPM. The resulting slurry was milled on a roller mill for 16 hours with 1.8 mm $ZrO_2$ beads to produce ion-exchanged fixing agent F2.

F3

Dowex® SBR ($Cl^-$) Form, Type1, Spherical Beads (strong base; styrene-DVB copolymer; trimethylbenzyl ammonium active group; total exchange capacity=3.1 meq/g) ion-exchange resin was milled to generate a dispersion with an average particle size of 0.7 um. To 10 g of this milled Dowex® resin were added 145 g of a solution which contained 10 wt. % of sodium thiosulfate pentahydrate. The mixture was stirred for five minutes, and the resin particles were separated from the liquid phase by centrifugation. The resin particles were washed with 140 g of distilled, de-ionized water three times. The resulting thiosulfate loaded resin particles were added to 90 g of distilled water to produce ion-exchanged fixing agent F3.

Two coatings were prepared containing, on a 1 $m^2$ basis, 12.1 g of de-ionized gelatin and 9.8 g of F2 and F3, respectively. Coatings containing 0.5 $g/m^2$ of silver bromoiodide and 4.31 $g/m^2$ of gelatin were moistened in a 5% sodium chloride solution and brought in contact with the ion-exchanged fixing sheet. The coatings were passed through a set of pinch rollers, and held for 1 minute, then peeled apart and washed. The status M visual optical density of the silver halide coating before and after this treatment was measured and is tabulated in Table I. Results in Table I clearly demonstrate the silver halide was removed (fixed) by this treatment.

TABLE I

Change in Status M visual density of processed coatings

| Laminate | Status M Optical Density (visual) |
|---|---|
| Untreated (comparison) | 0.23 |
| F2 (invention) | 0.02 |
| F3 (invention) | 0.02 |

The following coatings were prepared to demonstrate the advantages of ion exchange resin fixing agents over conventional preparation of fixing agents in the examples that follow.

Preparation of Ion Exchanged Fixing Agent Dispersion F4:

F4

DOWEX SBR Type 1 anionic resin was obtained from the Dow Chemical Company and milled to a mean particle size of 1 micron. To 91.4 gm of distilled water was added 9.14 gm of sodium thiosulfate pentahydrate. To this was added 6.92 gm of the anionic resin. The resulting suspension was homogenized for 10 minutes using a high shear mixer. The fluid was then centrifuged, the supernatant removed, and the solids redispersed with fresh distilled water. The residue was washed by the above centrifugation and redispersal procedure three additional times.

Preparation of Inventive Coating I-1 containing ion exchange resin:

The above prepared resin F4 was coated onto a flexible transparent support at a level of 194 mg/dm$^2$. Deionized gelatin was also coated at a level of 122 mg/dm$^2$. The coating was hardened with BVSME.

Preparation of Comparison Coating C-1 Containing Free Sodium Thiosulfate:

Sodium thiosulfate was dissolved in distilled water and coated onto a flexible transparent support at a level of 72.1 mg/dm$^2$. This coated level was calculated to be equimolar to the level of sodium thiosulfate in coating I-1 given an exchange capacity of 3.1 milli equivalents per gram. Deionized gelatin was also coated at a level of 122 mg/dm$^2$. The coating was hardened with BVSME.

Preparation of Coated Emulsion Layer E-1:

A tabular silver bromoiodide emulsion E1 (0.55×0.08 um) was optimally spectrally and chemically sensitized to green light. This emulsion was coated onto a clear flexible support at a level of 5.4 mg Ag/dm$^2$. Gelatin was also coated at a level of 64.6 mg/dm$^2$. The coating was hardened with BVSME.

Final Preparation of Thiosulfate Containing Coatings:

Two samples each of the sodium thiosulfate containing coatings C-1 and I1 above were evaluated. One sample consisted of the coatings as described. Another sample was immersed in a distilled water bath for 5 minutes and then dried. This sample treatment was intended to model liquid and vapor water contact in an open storage environment and serve as a measure of coating robustness. Table II below contains the designations for all four samples to be used in the examples.

TABLE II

Description of laminate samples

| Sample ID | Contacted with Water? | Sample Type |
|---|---|---|
| C-1A | no | comparison |
| C-1B | yes | comparison |
| I-1A | no | invention |
| I-1B | yes | invention |

EXAMPLE 3

Demonstration of Improved Raw Stock Keeping

Samples C-1A and I-1A were stored at room temperature for 3 days. Sample C-1A developed large crystals that were randomly distributed over the film surface. Sample I-1remained uniform and identical in appearance to the original state. These observations show that in the absence of the positively charged and ballasted resin, the soluble sodium thiosulfate molecule can re-distribute itself within a coating. This is undesirable as film plane uniformity is critical in photographic materials.

EXAMPLE 4

Demonstration of Fixing Effectiveness

Emulsion coating E-1 was soaked in an aqueous 7.5 weight percent sodium chloride solution at 25 C. for 15 seconds. This coating was then laminated to coating C-1A. After 2 minutes the laminated materials were peeled apart and the emulsion layer was washed in distilled water for 5 minutes and dried. Coating C-1A was dried. Total silver content in the emulsion layer before and after lamination was measured by an X-ray fluorescence spectroscopic method. The identical procedure was completed for samples C-1A, I-1A, and I-1B. The results are shown in Table III. Silver levels below 0.3 mg/dm$^2$ could not be accurately determined by the analytical method.

TABLE III

Silver levels measured for coating E-1 before and after lamination

| Emulsion/Laminate Combination | mg/dm$^2$ Silver Before Lamination | mg/dm$^2$ Silver After Lamination |
|---|---|---|
| E-1/C-1A | 5.8 | <0.3 |
| E-1/C-1B | 5.8 | 5.8 |
| E-1/I-1A | 5.8 | <0.3 |
| E-1/I-1B | 5.8 | <0.3 |

The data in the table show that laminate C-1A was able to remove silver from the emulsion layer. However, laminate C-1B was completely ineffective at removing any silver. This is because all of the sodium thiosulfate was washed out in the water immersion step. Both samples I-1A and I-1B were effective at removing silver from the emulsion layer. It is clear from the above data that the laminates containing the ion exchange resin were able to deliver thiosulfate ion to the emulsion layer and remove virtually all of the coated photographic silver. In addition, the ion exchange resin was able to keep the thiosulfate ion from being removed through contact with water, something that the free thiosulfate coatings could not accomplish.

EXAMPLE 5

Demonstration of Improved Transfer of Fixed Silver to the Laminate Layer

The laminate layers from example 4 were measured before and after lamination for silver content by the same X-ray fluorescence spectroscopic method. The results are shown in Table IV.

TABLE IV

Silver levels measured in laminates before and after lamination

| Emulsion/Laminate Combination | $mg/dm^2$ Silver Before Lamination | $mg/dm^2$ Silver After Lamination |
|---|---|---|
| E-1/C-1A | 0.0 | 3.6 |
| E-1/C-1B | 0.0 | 0.0 |
| E-1/I-1A | 0.0 | 4.5 |
| E-1/I-1B | 0.0 | 5.1 |

The data in the table show that more silver was transferred to the laminates containing the ion exchange resin than the comparative example laminates. The ion exchange resin contains a positive charge that not only can bind to the negatively charged thiosulfate ion, but can also bind to the negatively charged thiosulfate/silver ion complex that is created during the lamination step. It should be noted that some silver appears to be missing between the emulsion layer and laminate layer analyses. This silver is likely complexed with thiosulfate ion in the emulsion layer at the time the two layers are separated. This silver is subsequently removed from that layer during the post lamination wash step.

The following materials were prepared to demonstrate the advantages of ion exchange resin base releasing agents over the conventional preparation of base release agents in the examples that follow. Unless otherwise stated, the base release agents were soluble in water and prepared as aqueous solutions.

Preparation of Ion Exchange Base Releaser B1

B1

DOWEX SBR Type 1 anionic resin was obtained from the Dow Chemical Company and milled to a mean particle size of 1 micron. To 16.0 gm of resin slurry (16.7% solids) was added 17.0 gm of a 30.6% aqueous solution of sodium trichloroacetate. The resulting suspension was homogenized for 10 minutes using a high shear mixer. The fluid was then centrifuged, the supernatant removed, and the solids redispersed with fresh distilled water. The residue was washed by the above centrifugation and redispersal procedure three additional times. The resulting slurry was measured to be 12.4% solids.

Preparation of Comparative Base Releaser X1:

X1

Base release agent BAS-1 was dissolved in a 1:9 by weight mixture of toluene:methanol. The concentration of base release agent was 10 weight percent.

EXAMPLE 6

Demonstration of Base Release Agents to Change pH

To 50 gm of distilled water was added an equimolar (0.3 mol) amount of base releaser shown in Table V. The pH was recorded at 40 C. Solutions were then brought to a boil and held for 10 minutes. Solutions were placed in a 40 C. bath and allowed to cool for approximately 30 seconds. The weight was recorded, then water was added to bring the total weight back to 50 grams. The pH was recorded after 1 minute of reaching temperature. 2.5 gm Teflon boiling stones were used to prevent superheating.

TABLE V

Boiling experiments demonstrating base release

| Agent | Sample Type | Initial pH | Final pH |
|---|---|---|---|
| none | comparison | 4.7 | unchanged |
| guanidine trichloroacetate | comparison | 5.1 | 8.9 |
| sodium trichloroacetate | comparison | 5.2 | 9.3 |
| Dowex SBR blank | comparison | 4.6 | unchanged |
| B1 | invention | 4.6 | 7.0 |

From the above experiment, it is clear that the washed ion exchange resin retained the base release trichloroacetate ion and was able to shift the pH of the solution in similar fashion to the soluble trichloroacetate salts.

EXAMPLE 7

Demonstration of Base Release Performance in Photothermographic Coatings

For the following examples, photothermographic coatings were made with a variety of base release materials. The format of the coatings was common for all compounds and is shown in Table VI. The formulation was coated on a 7 mil thick poly(ethylene terephthalate) support.

Tabular emulsion E2 (0.55×0.08 um) was optimally spectrally and chemically sensitized to blue light. Silver donor S1 was a radiation insensitive silver salt of3-amino-5-benzylmercapto-1,2,4-triazole prepared by conventional precipitation methods. The base releasing components were coated at equimolar levels.

TABLE VI

Example 7 coating format

| Component | Laydown |
|---|---|
| silver (from emulsion E2) | 0.65 $g/m^2$ |
| silver (from silver salt S1) | 0.65 $g/m^2$ |
| Elon developer DEV-1 | 0.65 $g/m^2$ |
| salicylanilide | 1.08 $g/m^2$ |
| base releasing agent | 12.2 $mmol/m^2$ |
| lime processed gelatin | 6.09 $g/m^2$ |

TABLE VII

Description of coatings for Example 7

| Coating | Base Release Agent |
|---|---|
| C-2 | none |
| C-3 | guanidine trichloroacetate |
| C-4 | sodium trichloroacetate |
| C-5 | X1 |
| I-2 | B1 |

Coating Evaluation:

The resulting coatings were exposed through a step wedge to a 2.40 log lux light source at 5500K and Wratten 2B filter. The exposure time was 1/25 second. After exposure, the coating was contacted with a heated platen at 110 or 120° C. for 10 seconds and evaluated for image. A negative silver image was observed for all coatings. A silver scale image was observed for the blocked black and white developer DEV-1. The results are summarized in Table VIII. The density measured for each coating was Status M visual density. Discrimination is calculated as the difference between the maximum density (Dmax) and the minimum density (Dmin) divided by the minimum density.

TABLE VIII

Summary of photographic results for Example 7

| Coating | Agent | Process | Dmin | Dmax | Discrim. |
|---|---|---|---|---|---|
| C-2 | none | 10"/110 C | 0.12 | 0.21 | 0.83 |
| C-3 | guanidine trichloroacetate | 10"/110 C | 0.15 | 0.39 | 1.66 |
| C-4 | sodium trichloroacetate | 10"/110 C | 0.12 | 0.32 | 1.69 |
| C-5 | X1 | 10"/110 C | 0.10 | 0.17 | 0.73 |
| I-2 | B1 | 10"/110 C | 0.07 | 0.39 | 4.50 |
| C-2 | none | 10"/120 C | 0.25 | 0.32 | 0.29 |
| C-3 | guanidine trichloroacetate | 10"/120 C | 0.18 | 0.42 | 1.37 |
| C-4 | sodium trichloroacetate | 10"/120 C | 0.13 | 0.29 | 1.27 |
| C-5 | X1 | 10"/120 C | 0.21 | 0.32 | 0.55 |
| I-2 | B1 | 10"/120 C | 0.07 | 0.38 | 4.53 |

The data in the table shows that all of the trichloroacetate base releasers increased developed density over the control without base releaser. Fog was controlled better with the ion-exchanged base releasing agent, resulting in much superior image discrimination. Base releaser X1 would be expected to be reasonably inactive at these processing temperatures, and this is confirmed by the data.

DEV-1

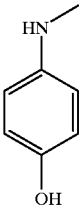

BAS-1

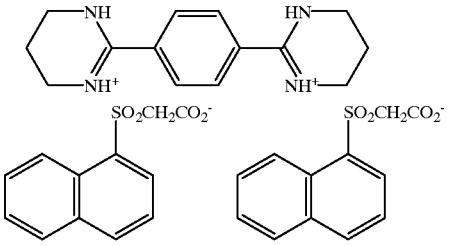

BVSME

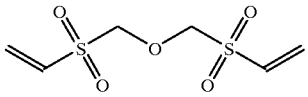

The invention has been described in detail with particular reference to certain preferred embodiments thereof, but it will be understood that variations and modifications can be effected within the spirit and scope of the invention.

What is claimed is:

1. A photographic element comprising a support bearing a layer comprising at least one photographically useful compound, other than a reducing agent, ionically bound to an ion exchange matrix.

2. A photographic element according to claim 1, wherein the element further comprises at least one light-sensitive silver halide layer.

3. A photographic element according to claim 1 or claim 2, wherein the photographically useful compound is chosen from the group consisting of a coupler, a development inhibitor, a base, a base precursor, an acid, an acid precursor, a ligand capable of binding silver, a fixing agent, a bleaching agent, an antifoggant, a toning agent, and a silver stabilizing agent.

4. A photographic element according to claim 1 or claim 2, wherein the ion exchange matrix has a refractive index between 1.4 and 1.7.

5. A photographic element according to claim 1 or claim 2, wherein the ion exchange matrix is an organic synthetic resin.

6. A photographic element according to claim 5, wherein the ion exchange matrix is a cationic ion exchange resin.

7. A photographic element according to claim 6, wherein the cationic ion exchange resin carries one or more of the following ionic groups:

$So_3^-$, $COO^-$, $PO_3^{2-}$, $HPO_2^-$, $AsO_2^-$, $SeO_3^-$.

8. A photographic element according to claim 7, wherein the cationic ion exchange resin carries $SO_3^-$ ionic groups.

9. A photographic element according to claim 7, wherein the cationic ion exchange resin carries $COO^-$ ionic groups.

10. A photographic element according to claim 7, wherein the cationic ion exchange resin is a sulfonated copolymer derived from styrene and divinylbenzene having a sulfonation level between about 3 to about 5 meq/g.

11. A photographic element according to claim 5, wherein the ion exchange matrix is an anionic ion exchange resin.

12. A photographic element according to claim 11, wherein the anionic ion exchange resin carries one or more of the following ionic groups:

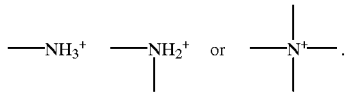

13. A photographic element according to claim 11, wherein the anionic ion exchange resin comprises a copolymer derived from styrene and divinylbenzene containing trimethylbenzylammonium chloride.

14. A photographic element according to claim 1 or claim 2, wherein the photographically useful compound comprises a ligand capable of binding silver.

15. A photographic element according to claim 14, wherein the ligand capable of binding silver has a chemical structure containing an amine or sulfonic acid group.

16. A photographic element according to claim 14, wherein the ligand capable of binding silver is thiosulfate or thiocyanate.

17. A photographic element according to claim 14, wherein the ligand capable of binding silver is a substituted 1,2,4-triazolium-3-thiolate.

18. A photographic element according to claim 1 or claim 2, wherein the photographically useful compound comprises a base precursor.

19. A photographic element according to claim 18, wherein the base precursor is a carboxylic acid.

20. A photographic element according to claim 2, wherein the photographically useful compound ionically bound to an ion exchange matrix is in the light-sensitive layer.

21. A photographic element according to claim 2, wherein the photographic element further comprises a light-insensitive layer and the photographically useful compound ionically bound to an ionic exchange matrix is in the light-insensitive layer.

22. A photographic element according to claim 21, wherein the light-insensitive layer is adjacent to the light-sensitive layer.

23. A photographic element according to claim 1 or claim 2, wherein the ionic exchange matrix comprises particles with average particle size less than 10 $\mu$m in diameter.

24. A photographic element according to claim 23, wherein the ionic exchange matrix comprises particles with average particle size less than 5 $\mu$m in diameter.

25. A photographic element according to claim 1 or claim 2, wherein the ion exchange matrix comprises a water-insoluble polymer.

26. A photographic element according to claim 1 or claim 2, wherein the photographically useful compound is present in an amount of about 5 to about 100 mol percent of the ion exchange stoichiometric capacity.

27. A method of activating the photographically useful compound incorporated in a photographic element which comprises a support, at least one light-sensitive silver halide emulsion layer, and a photographically useful compound ionically bound to an ion exchange resin, said method comprising contacting the element with a solution , or a solution contained within an ionic binder, having an ionic strength of greater than 0.001 M.

28. A method according to claim 27, wherein the process is conducted at a temperature above 40° C.

29. A method according to claim 28, wherein the amount of activator solution is about 5% to about 150% of the amount needed to fully swell the coating.

30. A method of activating a photographically useful compound incorporated in a photographic element which comprises at least one light sensitive layer on a support, wherein the photographic element also comprises at least one photographically useful compound, other than a reducing agent, ionically bound to an ion exchange matrix said method comprising heating the element to a temperature above about 50° C.

31. A method of processing a photographic element which comprises a support, at least one light-sensitive silver halide emulsion layer, and a photographically useful compound, other than a reducing agent, ionically bound to an ion exchange resin, said method comprising contacting the element with a processing solution, or a solution contained within a coated binder, having a pH greater than 8.

32. A method of according to claim 31, wherein the processing solution, or a solution contained within a coated binder, is sodium hydroxide or sodium carbonate.

33. A method according to claim 32, wherein the process is conducted at a temperature above 40° C.

34. A method according to claim 33, wherein the amount of activator solution is about 5% to about 150% of the amount needed to fully swell the coating.

35. A method of processing a photographic element comprising a support and at least one silver halide light-sensitive emulsion layer which comprises contacting the element with (a) a processing solution and (b) a sheet comprising a support and a photographically useful compound , other than a reducing agent, ionically bound to ion exchange matrix.

36. A method of processing a photographic element comprising a support and at least one silver halide light-sensitive emulsion layer which comprises contacting the element with (a) a processing solution having a pH of about 8–13 and (b) a sheet comprising a support and a photographically useful compound, other than a reducing agent, ionically bound to an ionic exchange matrix.

37. A method of processing a photographic element comprising a support and at least one silver halide light-sensitive emulsion layer which comprises contacting the element with (a) a processing solution having an ionic strength of greater than 0.001 M and (b) a sheet comprising a support and a photographically useful compound, other than a reducing agent, ionically bound to an ion exchange matrix.

38. A method of processing a photographic element comprising a support and at least one silver halide light-sensitive layer which comprises contacting the element with (a) a sheet comprising a support and a photographically useful compound, other than a reducing agent, ionically bound to an ion exchange matrix and (b) with thermal energy to elevate the temperature above 50° C.

39. A method of imaging comprising the steps of:

forming an image in an imagewise exposed light-sensitive silver halide element comprising a support and at least one silver halide light-sensitive emulsion layer by the method of claim 35, 36, 37, or 38;

scanning said formed image to form a first electronic image representation from said formed image;

digitizing said first electronic image to form a digital image;

modifying said digital image to form a second electronic image representation; and transforming, storing, transmitting, printing or displaying said second electronic image representation.

40. A method of forming an image comprising the steps of:

forming and image in an imagewise exposed light-sensitive silver halide element comprising a support and at least one silver halide light-sensitive emulsion layer by a method of claim 35, 36, 37, or 38;

scanning said formed image to form an electronic image representation from said formed image; and transforming, storing, transmitting, printing or displaying said electronic image representation.

41. A method of imaging comprising the steps of:

forming an image in an imagewise exposed light-sensitive silver halide element comprising a support and at least one silver halide light sensitive emulsion layer and a photographically useful compound, other than a reducing agent, ionically bound to an ion exchange resin;

scanning said formed image to form a first electronic image representation form said formed image;

digitizing said first electronic image to form a digital image;

modifying said digital image to form a second electronic image representation; and transforming, storing, transmitting, printing or displaying said second electronic image representation.

42. A method of forming an image comprising the steps of:

forming an image in an imagewise exposed light-sensitive silver halide element comprising a support and at least one silver halide light sensitive emulsion layer and a photographically useful compound, other than a reducing agent, ionically bound to an ion exchange resin;

scanning said formed image to form an electronic image representation from said formed image; and transforming, storing, transmitting, printing or displaying said electronic image representation.

* * * * *